US007462257B2

(12) United States Patent
Beuther et al.

(10) Patent No.: US 7,462,257 B2
(45) Date of Patent: Dec. 9, 2008

(54) METHOD FOR PRODUCING WET-PRESSED, MOLDED TISSUE PRODUCTS

(75) Inventors: Paul D. Beuther, Neenah, WI (US); Jeffrey D. Holz, Sherwood, WI (US); Stephanie Lee Oliver, Greenville, WI (US)

(73) Assignee: Kimberly-Clark Worldwide, inc., Neenah, WI (US)

( * ) Notice: Subject to any disclaimer, the term of this patent is extended or adjusted under 35 U.S.C. 154(b) by 644 days.

(21) Appl. No.: 11/019,116

(22) Filed: Dec. 21, 2004

(65) Prior Publication Data

US 2006/0130985 A1 Jun. 22, 2006

(51) Int. Cl.
*B31F 1/12* (2006.01)
*D21F 11/00* (2006.01)

(52) U.S. Cl. ..... 162/111; 162/205; 162/900

(58) Field of Classification Search ..... 162/109, 162/111, 115–117, 202, 204–20, 358.1–358.3, 162/900
See application file for complete search history.

(56) References Cited

U.S. PATENT DOCUMENTS

| | | | | |
|---|---|---|---|---|
| 4,309,246 | A | 1/1982 | Hulit et al. | |
| 4,482,429 | A | 11/1984 | Klowak | |
| 4,561,939 | A | 12/1985 | Justus | |
| 4,849,054 | A | 7/1989 | Klowak | |
| 5,178,732 | A | 1/1993 | Steiner et al. | |
| 5,411,636 | A | 5/1995 | Hermans et al. | |
| 5,598,643 | A | 2/1997 | Chuang et al. | |
| 5,699,626 | A | 12/1997 | Chuang et al. | |
| 5,701,682 | A | 12/1997 | Chuang et al. | |
| 6,103,062 | A | 8/2000 | Ampulski et al. | |
| 6,193,839 | B1 | 2/2001 | Ampulski et al. | |
| 6,423,186 | B1 | 7/2002 | Trokhan et al. | |
| 6,660,362 | B1 * | 12/2003 | Lindsay et al. | 428/131 |
| 7,186,317 | B2 * | 3/2007 | Beuther et al. | 162/109 |

(Continued)

FOREIGN PATENT DOCUMENTS

| | | |
|---|---|---|
| EP | 0400843 A2 | 12/1990 |

(Continued)

OTHER PUBLICATIONS

Search Report and Written Opinion for PCT/US2005/033793, Feb. 6, 2006.

*Primary Examiner*—José A Fortuna
(74) *Attorney, Agent, or Firm*—Dority & Manning, P.A.

(57) ABSTRACT

A process for producing tissue webs is disclosed. The process may include the step of partially dewatering a tissue web, subjecting the web to at least one deflection against a fabric, such as a coarse fabric, and then creping the web. During the process, after being dewatered, the tissue web is transferred from a transfer conveyor to the fabric using a pneumatic force, such as a suction force. In order to prevent liquids from rewetting the tissue web as the tissue web is being transferred to the fabric, the transfer conveyor is made from a material that inhibits or prevents liquids from flowing into the tissue web. For instance, in one embodiment, the transfer conveyor may comprise a felt comprised of small capillary materials. The felt may have an intake rate, for instance, of less than about 150 μL/s when wet, may have a mean free pore size of less than about 20 microns, and may have a minimum pore size of less than about 5 microns.

24 Claims, 3 Drawing Sheets

U.S. PATENT DOCUMENTS

2003/0033727 A1* 2/2003 Stelljes et al. ..... 34/361
2005/0126728 A1* 6/2005 Beuther et al. ..... 162/109
2005/0268274 A1* 12/2005 Beuther et al. ..... 717/100
2006/0130985 A1* 6/2006 Beuther et al. ..... 162/111
2006/0243408 A1* 11/2006 Blodgett et al. ..... 162/193
2007/0151692 A1* 7/2007 Beuther et al. ..... 162/199

FOREIGN PATENT DOCUMENTS

EP 0400843 A3 12/1990
WO WO 2006068678 A1 * 6/2006

* cited by examiner

METHOD FOR PRODUCING WET-PRESSED, MOLDED TISSUE PRODUCTS

BACKGROUND OF THE INVENTION

Many tissue products, such as facial tissue, bath tissue, paper towels, industrial wipers, and the like, are produced according to a wet laid process. Wet laid webs are made by depositing an aqueous suspension of pulp fibers onto a forming fabric and then removing water from the newly-formed web. Water is typically removed from the web by mechanically pressing water out of the web which is referred to as "wet-pressing". Although wet-pressing is an effective dewatering process, during the process the tissue web is compressed causing a marked reduction in the caliper of the web and in the bulk of the web.

For most applications, however, it is desirable to provide the final product with as much bulk as possible without compromising other product attributes. Thus, those skilled in the art have devised various processes and techniques in order to increase the bulk of wet laid webs. For example, creping is often used to disrupt paper bonds and increase the bulk of tissue webs. During a creping process, a tissue web is adhered to a heated cylinder and then creped from the cylinder using a creping blade.

As an alternative to wet-pressing processes, through-drying processes have developed in which web compression is avoided as much as possible in order to preserve and enhance the bulk of the web. These processes provide for supporting the web on a coarse mesh fabric while heated air is passed through the web to remove moisture and dry the web.

Although through-dried tissue products exhibit good bulk and softness properties, through-drying tissue machines are expensive to build and operate. Accordingly, a need exists for producing higher quality tissue products by modifying existing, conventional, wet-pressing tissue machines.

In this regard, U.S. Pat. No. 5,411,636 to Hermans, et al., which is incorporated herein by reference, discloses a process for improving the internal bulk of a tissue web by first dewatering a web and then subjecting the tissue web to differential pressure while supported on a coarse fabric at a consistency of about 30% or greater. The processes disclosed in the '636 patent provide various advantages in the art of tissue making.

Additional improvements in the art, however, are still needed. For instance, after the web is dewatered, the web is typically transferred from a felt onto the fabric using air pressure, such as a suction force. One problem that has been experienced in the past is that during the transfer from the felt to the fabric, the tissue web becomes rewetted. In particular, the suction force applied to the tissue web may cause water contained within the felt to be transferred into the tissue web as the web is transferred onto the fabric. In some instances, for example, the consistency of the tissue web may decrease in amounts greater than about 4% during the transfer. This water that is transferred back into the tissue web must then be removed during the final drying step of the web which not only increases the energy requirements of the process but also may cause the retention time of the web on the dryer to be increased. Ultimately, rewetting of the tissue web during the transfer to the fabric can result in significant added expense to the process.

In view of the above, a need currently exists for an improved process for producing tissue webs that couples wet-pressing with molding to create a low-density tissue product. In particular, a need exists for inhibiting a tissue web from being rewetted after the web has been dewatered and transferred to a fabric.

SUMMARY OF THE INVENTION

The present disclosure is generally directed to further improvements in the art of tissue making. In particular, a tissue making process is disclosed in which wet pressing is coupled with molding to create tissue products having good bulk and low density characteristics. During the process, a wet web containing papermaking fibers is first dewatered and then transferred to a fabric which may be a coarse fabric for molding the web against the fabric. According to the process of the present invention, the web is dewatered and transferred to the fabric under a suction force without a substantial amount of rewetting of the tissue web occurring. The problems associated with rewetting upon transfer to the fabric are minimized by incorporating into the process a transfer conveyor, such as a felt, that has particular characteristics or is made from a particular construction.

For example, in one embodiment, the present invention is directed to a method of producing tissue products comprising the steps of first depositing an aqueous suspension of papermaking fibers onto a forming fabric to form a wet web. The wet web is dewatered to a consistency of at least about 30%, such as from about 30% to about 70%. The web can be dewatered using various techniques. In one particular embodiment, for instance, the web is fed through a press nip and dewatered.

After being dewatered, the web is conveyed on a transfer conveyor which, in one embodiment, may comprise a transfer felt. In accordance with the present invention, the transfer felt has a liquid intake rate of less than about 150 μL/s, such as less than about 100 μL/s. For example, in one embodiment, the transfer felt may have a liquid intake rate of less than about 75 μL/s or even less than 65 μL/s. By having a low intake rate as defined below, the transfer felt is less likely to release water as the dewatered web is released off the transfer felt.

From the transfer felt, the web is transferred to a fabric and may be deflected against the fabric for molding the web and increasing the bulk of the web. From the fabric, the web is then conveyed onto a drying drum and creped from the drum. In one embodiment, for instance, an adhesive may be applied to the tissue web in order to adhere the web to the drying drum. In addition to facilitating creping of the web, the drying drum dries the web to a final dryness.

During the process, the web is transferred from the transfer felt to the fabric using a pneumatic force. For example, in one embodiment, a suction force positioned against the fabric may be used to not only transfer the web to the fabric but also to deflect the web against the fabric. According to the present invention, the above transfer can take place without the tissue web decreasing substantially in consistency. For example, during the transfer from the transfer felt to the fabric, the consistency of the web decreases no more than by about 2%, such as by no more than about 1%.

The transfer conveyor or felt used in the process may be constructed in various ways in order to achieve the characteristics necessary to minimize rewetting of the tissue web. For example, in one embodiment, the transfer felt is comprised of a fiber construction such that the felt has a mean free pore size of less than about 20 microns, such as less than about 18 microns, and, in one embodiment, can be less than about 15 microns. The transfer felt may have a minimum pore size of less than about 5 microns, such as less than about 4.5 microns, and, in one embodiment, may have a minimum pore size of less than about 4 microns.

The transfer felt may generally have a smooth surface, such as a surface smoother than the surface of the dewatering conveyor positioned upstream. In one embodiment, the transfer felt may be coated with a hydrophobic material. For example, any suitable hydrophobic polymer may be coated over the felt.

Transfer felts having the above-described characteristics have been found to resist the release of water during transfer of the dewatered web from the transfer felt to the fabric.

During the process, the wet web can be dewatered using various techniques. For example, in one embodiment, a through-air dryer or a drying cylinder may be used in order to dewater the web prior to being molded against a fabric. In an alternative embodiment, the wet web may be dewatered by being passed through a press nip. For instance, in one embodiment, a wet web may be placed on a dewatering felt and passed through a press nip formed between the dewatering felt and the transfer felt. After the web is passed through the press nip, the dewatered web is transferred from the dewatering felt to the transfer felt.

The press nip may have various constructions. For example, in one embodiment, the press nip may comprise a vacuum roll positioned opposite a press roll. In an alternative embodiment, the press nip may comprise a stationary shoe positioned opposite a press roll.

In general, any suitable tissue product may be made according to the above process. For instance, in one embodiment, the process may be used to form facial tissue or bath tissue. In this embodiment, the tissue web may have a basis weight of from about 10 gsm to about 25 gsm upon final drying.

In an alternative embodiment, the process of the present invention is used to produce a paper towel or industrial wiper. In this embodiment, the tissue web may have a basis weight of greater than about 30 gsm, such as from about 30 gsm to about 100 gsm.

Other features and aspects of the present invention are discussed in greater detail below.

BRIEF DESCRIPTION OF THE DRAWINGS

The following is a detailed description of the present invention including reference to the following figures in which.

Figure 1:
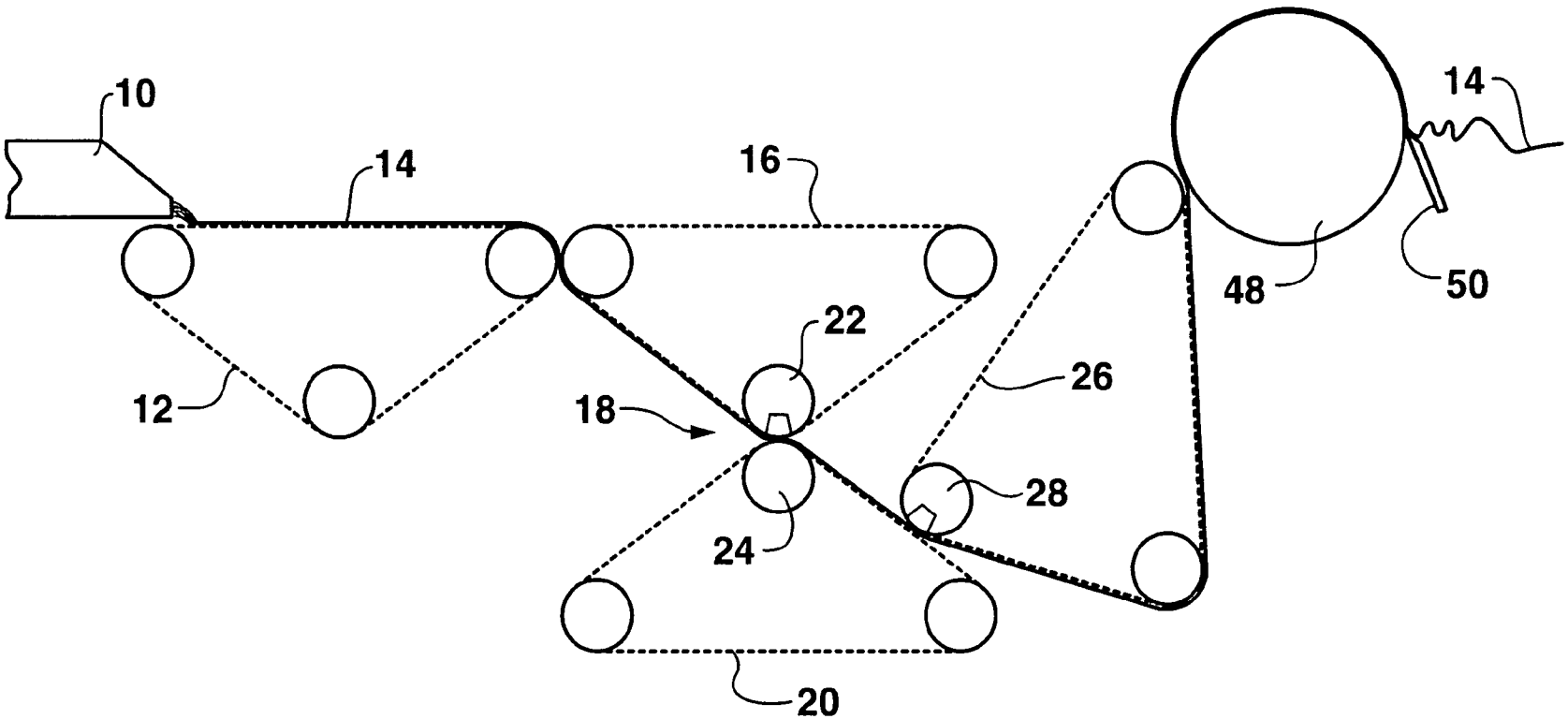
FIG. 1 is a side view of one embodiment of a process made in accordance with the present invention.

Repeat use of reference characters in the present specification and drawings is intended to represent the same or analogous features or elements of the invention.

DETAILED DESCRIPTION

It is to be understood by one of ordinary skill in the art that the present discussion is a description of exemplary embodiments only, and is not intended as limiting the broader aspects of the present invention, which broader aspects are embodied in the exemplary constructions.

In general, the present invention is directed to the formation of tissue webs having good bulk and softness properties while maintaining adequate strength properties. In general, the tissue webs are made by a wet-pressing process in combination with a molding process and a creping process in order to create a high bulk, low-density web. During the process, a wet web is first dewatered, placed on a transfer conveyor, and is then transferred to a fabric using a pneumatic force. Once on the fabric, the web is deflected against the fabric and, in one embodiment, molded against the fabric. After being deflected, the web is then placed on a drying drum and creped from the drum.

As described above, in the past, problems were experienced when transferring the dewatered web from the transfer conveyor to the fabric. Specifically, the transfer between the transfer conveyor and the fabric typically occurred using a suction force causing water contained in the transfer conveyor to rewet the tissue web. In fact, in some processes, the web was found to decrease in consistency by about 4% or greater after being transferred to the fabric.

In accordance with the present invention, the transfer conveyor is particularly constructed in order to substantially prevent the tissue web from being rewetted upon transfer to the fabric. For example, in one embodiment, the transfer conveyor comprises a felt that may have a smooth surface, a relatively small pore size, and/or an enhanced hydrophobic surface. In one particular embodiment of the present invention, for example, the transfer felt has a liquid intake rate (as defined in the examples below) of less than about 150 μL/s. Transfer felts designed in accordance with the present invention have been found not to easily release water after the felt has been wetted. In fact, the felt is resistant to releasing water when subjected to a pneumatic force sufficient to transfer a tissue web from the felt to a fabric. In this manner, rewetting of the tissue web during transfer to the fabric is minimized.

The process and the system of the present invention provide various advantages and benefits. For example, by preventing the tissue web from being rewetted, less energy is needed to dry the web on the drying drum. Thus, a smaller drying drum may be used, the drum may operate at a lower temperature, or the retention time of the web on the drying drum may be reduced. Ultimately, an energy savings is realized making the process more economical.

Referring to FIG. 1, one embodiment of a tissue making process in accordance with the present invention is shown. As illustrated, the system includes a head box 10 which deposits an aqueous suspension of papermaking fibers onto a forming fabric 12. The papermaking fibers can include, but are not limited to, all known cellulosic fibers or fiber mixes comprising cellulosic fibers. The fibers can include, for example, hardwood fibers such as eucalyptus fibers or softwood fibers, such as northern softwood kraft fibers. Other fibers may include high-yield fibers, recycled fibers, broke, synthetic cellulosic fibers, and the like.

Once the aqueous suspension of fibers is deposited onto the forming fabric 12, some of the water contained in the aqueous suspension is drained through the fabric and a tissue web 14 is formed. The wet web 14 retained on the surface of the forming fabric has a consistency of about 10%.

As shown in FIG. 1, the wet tissue web 14 is transferred to a dewatering conveyor 16 which may be, for instance, a papermaking felt. The tissue web 14 is then fed into a press nip 18 and further dewatered. The press nip 18 is formed between the dewatering conveyor 16 and a transfer conveyor 20 utilizing a first press roll 22 and a second press roll 24. If desired, one of the press rolls may comprise a vacuum roll to assist in draining fluids from the tissue web 14. For example, as shown in FIG. 1, the first press roll 22 may comprise a vacuum roll for applying a suction force to the web. The press nip dewaters the tissue web 14 to a consistency of about 30% or greater, such as from about 30% to about 70%. In one particular embodiment, for example, the tissue web is dewatered in the nip 18 to a consistency of about 35% to about 50%.

In FIG. 1, a press nip is shown formed between a pair of opposing press rolls. In other embodiments, multiple press nips may be used in order to dewater the web. Further, extended press nips may also be incorporated into the process. The extended press nip, for instance, may contain a stationary shoe positioned opposite a press roll. In this embodiment, the stationary shoe may apply a suction force to the tissue web. In further embodiments, a through-air dryer may be used in order to dewater the web.

Figure 2:
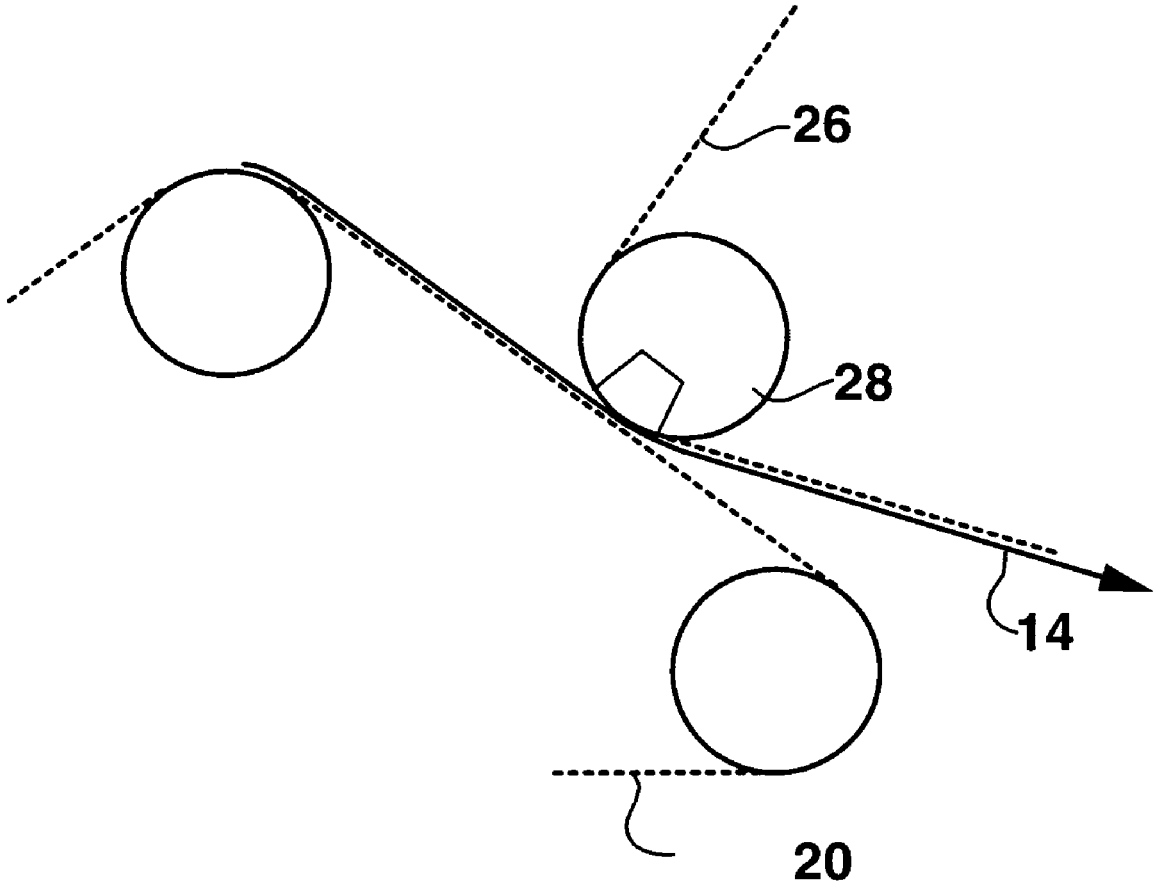
FIG. 2 is a partial exploded side view of the transfer of a tissue web from a transfer conveyor to a fabric as shown in FIG. 1.

From the nip 18, the tissue web 14 is conveyed on the transfer conveyor 20 and then transferred to a fabric 26, such as a coarse or molding fabric. In order to transfer the tissue web 14 from the transfer conveyor 20 to the fabric 26, a pneumatic force may be used. For example, as shown in FIGS. 1 and 2, a vacuum roll 28 may be positioned adjacent the fabric 26 for assisting in transferring the web onto the fabric using a suction force. The suction force not only assists in transfer of the tissue web but, in some embodiments, may also deflect the web 14 against the fabric 26. As used herein, the term "deflection" refers to a process in which a tissue web is biased against an opposing surface with a force sufficient to cause at least some of the fibers in the web to reorient. In some embodiments, the force may be sufficient to cause the web to mold and conform to the topography of the surface. In accordance with the process, deflection of the web against the fabric may occur against the vacuum roll 28 and/or may occur at other positions along the fabric 26. Further, it should be understood that in addition to a vacuum roll 28, other vacuum devices may be used, such as a stationary vacuum shoe.

In order to create a significant amount of fiber disruption, in one embodiment, the fabric 26 may comprise a coarse fabric. The nature of the coarse fabric is such that the wet web must be supported in some areas and unsupported in others in order to enable the web to flex in response to the differential air pressure or other deflection force applied to the web. Such fabrics suitable for purposes of this invention include, without limitation, those papermaking fabrics which exhibit significant open area or three dimensional surface contour or depressions sufficient to impart substantial z-directional deflection of the web. Such fabrics include single-layer, multi-layer, or composite permeable structures. Preferred fabrics have at least some of the following characteristics: (1) On the side of the fabric that is in contact with the wet web (the top side), the number of machine direction (MD) strands per inch (mesh) is from 10 to 200 and the number of cross-machine direction (CD) strands per inch (count) is also from 10 to 200. The strand diameter is typically smaller than 0.050 inch; (2) On the top side, the distance between the highest point of the MD knuckle and the highest point of the CD knuckle is from about 0.001 to about 0.02 or 0.03 inch. In between these two levels, there can be knuckles formed either by MD or CD strands that give the topography a 3-dimensional hill/valley appearance which is imparted to the sheet during the wet molding step; (3) On the top side, the length of the MD knuckles is equal to or longer than the length of the CD knuckles; (4) If the fabric is made in a multi-layer construction, it is preferred that the bottom layer is of a finer mesh than the top layer so as to control the depth of web penetration and to maximize fiber retention; and (5) The fabric may be made to show certain geometric patterns that are pleasing to the eye, which typically repeat between every 2 to 50 warp yarns. Suitable commercially available coarse fabrics include a number of fabrics made by AstenJohnson, including without limitation Asten 934, 920, 52B, and Velostar V800.

The amount of pneumatic pressure that is generated by the vacuum roll 28 as shown in FIGS. 1 and 2 may vary depending upon the particular application and the desired result. In general, gas pressures can be at least 1 inch Hg, at least 2 inches Hg, such as at least 4 inches Hg. The pressures may vary, for instance, from about 1 inch Hg to about 60 inches Hg, such as from about 4 inches Hg to about 20 inches Hg.

As shown in FIG. 1, after being conveyed on the fabric 26, the tissue web 14 is then transferred to a drying cylinder 48 in order to dry the web to a final dryness. The drying cylinder 48 may be, for instance, a Yankee dryer.

In one embodiment, an adhesive may be applied to the tissue web or to the dryer for adhering the web to the dryer. The adhesive may be, for instance, any suitable or conventionally used adhesive. For instance, in one embodiment, an adhesive containing polyvinyl alcohol may be used. The adhesive may be, for instance, sprayed onto the web. As shown in FIG. 1, once adhered to the drying cylinder 48, the tissue web 14 is creped from the cylinder using a creping blade 50. Creping the web serves to further cause fiber disruption and increase the bulk of the web. Once creped, the tissue web is wound onto a reel for converting and later packaging.

Although the process in FIG. 1 shows the use of a drying cylinder and creping blade, it should be understood that any suitable drying device may be used in the present invention. For example, in other embodiments, the process may include a through-air dryer.

Referring back to FIG. 2, as described above, after the tissue web 14 is dewatered in the press nip 18, the tissue web is then transferred from the transfer conveyor 20 to the fabric 26 using a pneumatic force, such as a suction force. Unfortunately, although the suction force facilitates transfer of the web 14 to the fabric 26 and may also deflect the web against the fabric, the suction force has a tendency to draw water from the transfer conveyor 20 back into the tissue web 14 causing the web to be rewetted. In accordance with the present invention, however, a transfer conveyor 20 is chosen that substantially inhibits water from rewetting the tissue web 14 upon transfer to the fabric 26.

For example, in one embodiment, the transfer conveyor 20 comprises a felt that minimizes the reverse flow of water into the tissue web 14 during the transfer. For instance, in accordance with the present invention, the transfer felt 20 can be constructed so as to retain water once wet and to prevent water from being released even when subjected to a suction force as may be applied by the vacuum roll 28. The transfer felt in one embodiment may be considered to operate like a "one-way door" that absorbs water in one direction but has a construction that inhibits the flow of water in an opposite direction.

The transfer felt 20 can be constructed in various ways from various materials in order to provide the characteristics that are desired. In one embodiment, for instance, the transfer felt 20 is made from a small capillary material. For instance, the felt may contain a woven fabric embedded with small diameter fibers. The small diameter fibers may account for greater than about 40%, such as greater than about 50%, and in one embodiment, may account for greater than about 60% of the mass of the overall felt. The fibers, for example, may have a diameter of about 1 denier or less. Any suitable fiber may be used to construct the felt, such as carded nylon fibers. If desired, the felt and/or the fibers may be treated with a wetting agent.

Such felt materials as described above desirably have various characteristics that the present inventors have found to be well suited for use in the process of the present invention. For example, the transfer felt 20 may have a liquid intake rate (as described in the examples below) of less than about 150 μL/s, such as less than about 100 μL/s. For instance, the transfer felt in particular embodiments may have a liquid intake rate of less than about 75 μL/s and even less than about 65 μL/s when wet. The liquid intake rate of the transfer felt is generally dependent upon the porosity of the felt structure, the capillary tension and/or the wettability of the material. Materials with lower intake rates have less tendency to release liquids, such as water, once wetted.

In addition to intake rate, the pore size of the transfer felt may also indicate the ability of the material to inhibit the flow of liquids out of the material. Transfer felts made according to the present invention, for example, may have a mean free pore size (as described in the examples below) of less than about 20 microns, such as less than about 18 microns, and, in one embodiment, may be less than about 15 microns. The transfer felt may also have a minimum pore size of less than about 5 microns, such as less than about 4.5 microns. In one particular embodiment, for example, the transfer felt may have a minimum pore size of less than about 4 microns.

Instead of or in addition to constructing the transfer felt from small capillary materials, the felt may also be formed so as to have an enhanced hydrophobic surface. For instance, in one embodiment, a felt material may be coated with a hydrophobic material in order to arrive at the above-described characteristics. Hydrophobic coatings can be made, for instance, from various polymeric materials, including various thermoplastic materials. Hydrophobic sizing agents may also be applied to the felt.

In order to assist transfer of the tissue web 14 from the dewatering conveyor 16 to the transfer conveyor 20, in one embodiment, the transfer conveyor 20 may also have a smoother surface than the dewatering conveyor 16. Of particular advantage, felt materials made with small capillary materials have a tendency to produce smooth surfaces.

The dewatering conveyor 16 may be constructed from various conventional materials in accordance with the present invention. For instance, the dewatering conveyor 16 may comprise any suitable felt material. In one particular embodiment, however, there may be advantages to having the dewatering conveyor 16 made from a felt material containing small capillary materials as described above with respect to the transfer felt 20. In some applications, there may be benefits to constructing the dewatering conveyor 16 out of a material that does not readily release liquids, such as water. For example, in certain applications, rewetting of the tissue web may also occur on the dewatering conveyor 16.

It should be understood that the embodiment illustrated in FIG. 1 merely represents one configuration of a tissue making process in accordance with the present invention. It should be understood that the process may include many more conveyors that comprise fabrics or felts as the tissue web is being formed. In fact, the dewatering of the web may occur upstream from the transfer conveyor 20.

The process of the present invention is particularly well suited to producing all different types of tissue products. The tissue products can have, for instance, a basis weight of from about 6 gsm to about 120 gsm. Tissue products that may be produced according to the present invention include paper towels, industrial wipers, and various products.

In one particular embodiment of the present invention, the process is used to produce facial tissue or bath tissue. The facial tissue webs or bath tissue webs can have a basis weight, for instance, of from about 6 gsm to about 45 gsm, such as from about 10 gsm to about 20 gsm. The final product can contain a single ply or can contain multiple plies (2 to 3 plies).

The present invention may be better understood with reference to the following example.

EXAMPLE 1

The following felt products were tested and compared for minimum pore size, maximum pore size, mean free pore size (MFP), and porosity: Albany Advantech™, Weavex Millennium™, Weavex Hyperpunch™, and AstenJohnson Helix™. Of the above listed felts, the Albany Advantech™ felt possesses the characteristics and properties needed for use in accordance with the present invention. In the past, it is believed that this felt product was used in processes for making highly compressed paper, such as stationery. The purpose of this example is to compare the properties of the Albany Advantech™ felt with the properties of other conventional felts that have been used in tissue making processes in the past.

The following is a description of the test methods.

The test sample is thoroughly wetted with a low-surface tension liquid. The sample is then placed into a porometer, where air pressure is applied to one side of the sample. The air pressure is slowly ramped up. At first, no flow should be detected on the other side of the sample due to the fact that all pores are filled with fluid. Eventually, as pressure is increased, the capillary forces within the largest pores are overcome. This will allow air to pass through and result in a change in flow rate on the detection side. This point is known as the bubble point of the sample. Gradually, the air pressure is increased, causing smaller pores to be dewetted and more air to flow through. The result of this is a flow rate versus applied pressure relationship. At the end of the run, the sample is completely dewetted, and is tested again over the same pressure range, producing a dry curve.

The diameter of a pore that opens at a given pressure can be determined from the equilibrium between the capillary tension of the pore and gravitational forces in the steady state.

$$2\pi r\gamma \cos\theta = r^2\pi\rho g h$$

where r is the radius of the capillary, γ is the surface tension of the wetting fluid, θ is the contact angle between the fluid and the capillary wall, ρ is the density of the fluid, g is the gravitation acceleration, and h is the height of the column of fluid in the capillary.

This will reduce to the Washburn equation, since the hydrostatic head can be translated into the pressure required to empty the pore (P), and two times the capillary radius equals the diameter (D).

$$4\gamma \cos\theta = PD$$

Coulter Porofil (a fluorinated hydrocarbon) is used as a wetting agent. The fluid is extremely wetting and saturates the entire pore structure of most materials, resulting in a zero contact angle. Thus, the above equation can be reduced and solved for diameter:

$$D = \frac{4\gamma}{P}$$

Note that this equation assumes that the capillaries (i.e. pores) are cylindrical in nature.

Equipment:

- Coulter Porometer with 1-inch diameter filter holder assembly installed
- Balance, capable of reading to the nearest 0.0001 gram
- Sample holder
- Thickness tester with platen Small stainless steel weighing pan, capable of holding fluid above the top surface of the felt samples Coulter® Porofil wetting fluid Tweezers, or equivalent, to handle samples.

Equipment Settings:

Wetting Fluid: Porofil

Size Factor: 0.64

Full Range Pore Size (Diameter)

Minimum: Depends on sample, typically between 2 and 4 μm*

Maximum: 200 μm

Cal Size (Other Fluid): 1.00

Data Smoothing: Off

*Note: A trial run must be completed with each sample using the steps below to verify that the minimum diameter selected is correct.

Sample Preparation:

Using a 1" diameter circular die, cut three samples from each felt to be tested. Make sure that die cuts all the way through and does not remove fibers from the sample.

Test Procedure

1. Place the sample holder (4 prongs connected to a support structure) onto the balance and tare the reading out.
2. Record the mass of the sample in grams.
3. Record the thickness of the sample in millimeters.
4. Pour a sufficient amount of Coulter® Porofil (approximately 5 millimeters deep) into a weighing pan to saturate the samples. Make sure that this pan stays sufficiently full for each sample to be tested.
5. Place the sample into the Porofil fluid and allow to soak until no bubbles are seen (approximately 30 seconds to 1 minute).
6. Remove the sample from the Porofil fluid. Allow excess fluid to drain. Keep sample parallel to the bench top. DO NOT tip to drain, as this may cause premature dewetting of the side structure.
7. Place sample onto the sample holder and record the mass.
8. Place the sample back into the Porofil to ensure that all pores are filled. Allow to drain as in step 6.
9. Place the sample into the filter assembly. Minimize the amount of force used to place the sample into the assembly to reduce the possibility of premature dewetting.
10. Place the filter assembly o-ring briefly into the wetting fluid.
11. Center the o-ring over the top of the sample such that the edges of the o-ring contact the inner diameter of the filter assembly.
12. Screw the filter assembly cap onto the lower section of the assembly. Make sure that the o-ring seals properly to the bottom portion of the cap.
13. Verify that the proper settings for the samples have been set, and that the "Full" window has been selected. If there is existing data, make sure to hit the "Reset" button.
14. Start the test. The porometer will test the sample in the wetted state in the pressure (diameter) range selected, and then repeat the test with the dried sample.
15. When the test is completed, the porometer will transfer the data to a microprocessor. To view the tabulated results from the porometer, press the "Distribution" button. This will provide the minimum, maximum, and mean flow pore sizes.
16. Remove the sample from the filter assembly.
17. Repeat steps 3 through 17 for each remaining sample.

Collection of Results

The porometer collects 256 data points (pressure and flow) across the entire pressure range selected for both the wet and dry curves. The first detectable flow during pressure ramp up is termed the bubble point, and indicates the largest pore size found in the sample. Note that the largest diameter is found at the smallest pressures, and vice versa.

The minimum pore size is determined by the pressure at which the wet flow reaches 98% of its maximum value.

Finally, the mean free pore size, or MFP, corresponds to the pressure value where the curve given by (50%×dry flow) crosses the wet flow curve.

Results

The results obtained are shown in the table below. For each sample, three repeats were completed. The minimum pore size, maximum pore size, mean free pore size (MFP), and the porosity are shown.

| | Min Pore (μm) | MFP (μm) | Max Pore (μm) | Porosity |
|---|---|---|---|---|
| Weavex Hyperpunch ™ | 5.53 | 22.88 | 77.46 | 0.62 |
| Albany Advantech ™ | 3.80 | 13.34 | 64.24 | 0.56 |
| Weavex Millennium ™ | 5.53 | 25.94 | 83.32 | 0.76 |
| AstenJonson Helix ™ | 6.81 | 25.18 | 77.16 | 0.67 |

According to the results collected, the Albany felt had the tightest pore structure.

EXAMPLE 2

The same felt products tested above were then tested and compared for their fluid intake rate. In this example, the characteristics of the Albany felt were again compared to the characteristics of the remaining felts.

The following is a description of the fluid intake rate test. As used herein, the fluid intake rate test is measured after the samples have been wetted.

The Kruss Drop Shape Analyzer (DSA) employs a high speed digital video camera and an automated fluid delivery system to dispense and measure the properties of a fluid drop on a given substrate surface. From the video capture system, the intake rate and contact angle of the drop can be measured.

Intake rate can be used in determining the relative ease of fluid absorption into a given structure. The intake rate is dependent upon the porosity, pore size distribution, and surface energy of the wetted material. For this test, the samples were pre-wetted to remove the effects of surface energy. Thus, contact angle does not need to be measured. In this configuration, the intake rate will provide a relative indication of the pore structure on the upper surface of the felt.

Equipment

Kruss Drop Shape Analyzer Model DSA10 (instrument+computer)

Kruss NE 43 syringe tip with removable PTFE-tube

Equipment Settings

Target Volume: 14.1 μL

Delivery Rate: 10 μL/min

Collect Every $N^{th}$ Frame: 2 (120 fps)

Collect for: 10 seconds (1200 total frames)
Test Fluid: Deionized Water

XYZ Table should be adjusted such that it is centered under the fluid delivery needle. Height of the table should be adjusted such that the top of a sample is visible in the video window, but the table is not visible. The distance between the top of the XYZ table and the fluid delivery needle should be 7 mm.

Sample Preparation

1. Cut a 1.5 cm×1.5 cm (approximate) square from the felt to be tested. Cut approximately 10 samples from various sections of the felt. Use heavy duty scissors to avoid accidental removal of fibers from the cut sample.
2. Place each sample (in order) into a deionized water bath. Allow the samples to soak for at least 15 minutes, but no more than 30 minutes.
3. Prior to testing, place each sample onto a dry piece of blotter paper for 30 seconds to remove excess water.

Test Procedure

1. Remove a sample from the soaking tray. Remove excess fluid by blotting the sample for 30 seconds.
2. Center the sample under the fluid delivery needle. Verify that the sample is positioned correctly in the frame grabber (FG) window.
3. Press the Record button on the DSA program window. Video will be paused.
4. Insult the sample. When fluid delivery is started, the video window will start recording.
5. Save the video when completed.
6. Open the video
7. Determine the time (in ms) at which the drop first contacted the surface of the felt as to.
8. Determine the last frame in which the drop is visible. Record the time (in ms) as $t_0$.
9. Remove the sample and repeat as necessary.

Results

The intake time for each repeat is calculated using the following formula:

$$t_{intake}=t_1-t_0$$

Report the average intake time for each code. The following Results were obtained:

| | Fluid Intake Rate (uL/s) | | | |
|---|---|---|---|---|
| Repeat | Albany Advantech | Weavex Millennium | Weavex Hyperpunch | AstenJohnson Helix |
| 1 | 76.6 | 199 | 282 | 239 |
| 2 | 62.7 | 126 | 239 | 282 |
| 3 | 41.2 | 199 | 261 | 336 |
| 4 | 60.3 | 170 | 227 | 243 |
| 5 | 52.0 | 141 | 243 | 214 |
| 6 | 38.5 | 141 | 282 | 224 |
| 7 | 65.0 | 210 | 282 | 199 |
| 8 | 66.5 | 153 | 243 | 227 |
| 9 | 45.2 | 199 | 336 | 227 |
| 10 | 43.5 | 214 | 256 | 282 |
| Average | 55.2 | 175 | 265 | 247 |

Figure 3:
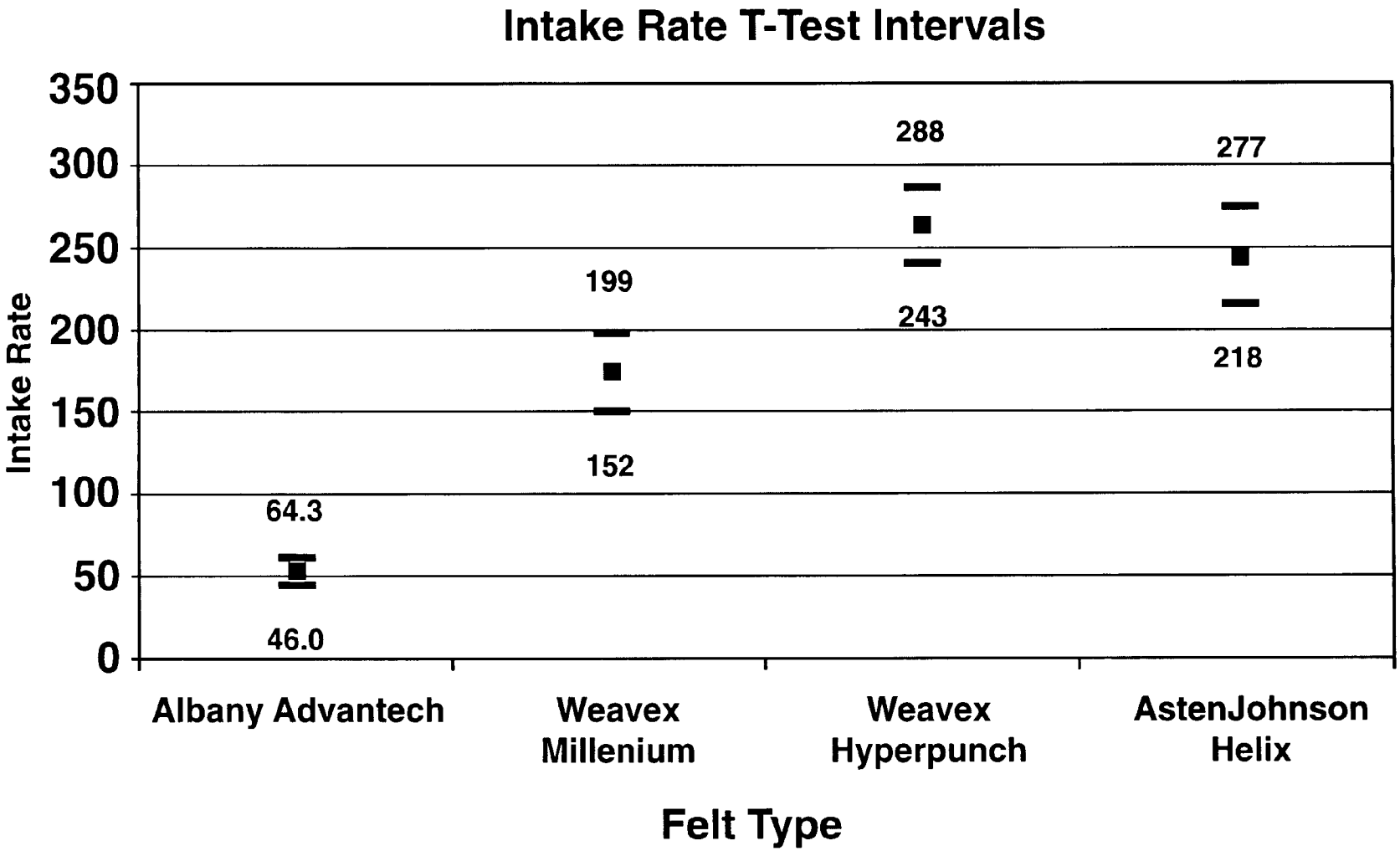
FIG. 3 is a graphical representation of the results obtained in the examples described below.

The results are also graphically illustrated in FIG. 3. As shown in FIG. 3, the Albany felt had a much lower fluid intake rate than the conventional felts.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed is:

1. A method of producing a tissue product comprising:
depositing an aqueous suspension of papermaking fibers onto a forming fabric to form a wet web;
dewatering the wet web to a consistency of at least about 30%;
conveying the dewatered web onto a transfer felt, the transfer felt having an intake rate of less than about 150 μL/s;
transferring the web from the transfer felt to a fabric and deflecting the web against the fabric; and
conveying the web onto a drying drum and creping the web from the drum.

2. A method as defined in claim 1, wherein the transfer felt has an intake rate of less than about 100 μL/s.

3. A method as defined in claim 1, wherein the transfer felt has an intake rate of less than about 75 μL/s.

4. A method as defined in claim 3, wherein the transfer felt has a mean free pore size of less than about 18 microns and has a minimum pore size of less than about 4.5 microns.

5. A method as defined in claim 3, wherein the transfer felt has a mean free pore size of less than about 15 microns and has a minimum pore size of less than about 4 microns.

6. A method as defined in claim 1, wherein the transfer felt has an intake rate of less than about 65 μL/s.

7. A method as defined in claim 1, wherein the transfer felt has a mean free pore size of less than about 20 microns.

8. A method as defined in claim 1, wherein the transfer felt has a minimum pore size of less than about 5 microns.

9. A method as defined in claim 1, wherein the wet web is dewatered by being passed through a press nip.

10. A method as defined in claim 9, further comprising the step of transferring the wet web from the forming fabric to a dewatering felt, the press nip being located between the dewatering felt and the transfer felt.

11. A method as defined in claim 10, wherein the dewatering felt has an intake rate of less than about 150 μL/s, has a mean free pore size of less than about 20 microns, and has a minimum pore size of less than about 5 microns.

12. A method as defined in claim 1, wherein the transfer felt comprises a felt material coated with a hydrophobic material.

13. A method as defined in claim 1, wherein the web has a consistency of from about 30% to about 70% after being dewatered.

14. A method as defined in claim 1, wherein the consistency of the web decreases by no more than 2% when the web is transferred from the transfer felt to the fabric.

15. A method as defined in claim 1, wherein the consistency of the web decreases by no more than 1% when the web is transferred from the transfer felt to the fabric.

16. A method as defined in claim 1, wherein the final dried web has a basis weight of from about 10 to about 25 gsm.

17. A method as defined in claim 1, wherein the final dried web has a basis weight of from about 30 to about 80 gsm.

18. A method as defined in claim 1, wherein a suction force against the fabric is used to transfer the web from the transfer felt and to deflect the web against the fabric.

19. A method of producing a tissue product comprising:
depositing an aqueous suspension of papermaking fibers onto a forming fabric to form a wet web;

conveying the wet web onto a dewatering felt and dewatering the web by passing the web through a press nip, the web being transferred onto a transfer felt after passing through the press nip, the transfer felt having an intake rate of less than about 150 μL/s, a mean free pore size of less than about 20 microns, and a minimum pore size of less than about 5 microns;

transferring the web from the transfer felt to a fabric and deflecting the web against the fabric, the web being transferred from the transfer felt to the fabric using a pneumatic force, the web decreasing in consistency by no more than about 2% when the web is transferred from the transfer felt to the fabric; and conveying the web onto a drying drum and creping the web from the drum.

20. A method as defined in claim 19, wherein the transfer felt has an intake rate of less than about 75 μL/s, has a mean free pore size of less than about 18 microns, and has a minimum pore size of less than about 4.5 microns.

21. A method as defined in claim 19, wherein the transfer felt has an intake rate of less than about 65 μL/s, has a mean free pore size of less than about 15 microns, and has a minimum pore size of less than about 4 microns.

22. A method as defined in claim 19, wherein the web decreases in consistency by no more than about 1% when transferred from the transfer felt to the fabric.

23. A method as defined in claim 19, wherein the pneumatic force that transfers the web from the transfer felt to a fabric comprises a suction force placed against the fabric, the suction force deflecting the web against the fabric.

24. A method as defined in claim 19, wherein the web has a consistency of from about 30% to about 70% after passing through the press nip.

* * * * *